US008913937B2

(12) United States Patent
Sakakibara

(10) Patent No.: US 8,913,937 B2
(45) Date of Patent: Dec. 16, 2014

(54) ROLLER FOR FIXING APPARATUS, AND IMAGE HEATING APPARATUS HAVING ROLLER FOR IMAGE FIXING APPARATUS

(75) Inventor: Hiroyuki Sakakibara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 165 days.

(21) Appl. No.: 13/446,309

(22) Filed: Apr. 13, 2012

(65) Prior Publication Data

US 2012/0269560 A1 Oct. 25, 2012

(30) Foreign Application Priority Data

Apr. 19, 2011 (JP) ..... 2011-093221
Mar. 14, 2012 (JP) ..... 2012-057080

(51) Int. Cl.
*G03G 15/20* (2006.01)

(52) U.S. Cl.
CPC ..... *G03G 15/2057* (2013.01)
USPC ..... 399/333; 399/331; 399/335

(58) Field of Classification Search
USPC ..... 399/330, 333, 335, 331
See application file for complete search history.

(56) References Cited

U.S. PATENT DOCUMENTS

| | | | | |
|---|---|---|---|---|
| 5,148,226 | A | 9/1992 | Setoriyama et al. | |
| 5,210,579 | A | 5/1993 | Setoriyama et al. | |
| 5,525,775 | A | 6/1996 | Setoriyama et al. | |
| 6,490,430 | B1 * | 12/2002 | Chen et al. | 399/333 |
| 6,617,090 | B2 * | 9/2003 | Pickering et al. | 399/330 X |
| 7,321,746 | B2 | 1/2008 | Sakakibara et al. | |
| 7,537,838 | B2 * | 5/2009 | Hirabayashi et al. | 399/330 X |
| 8,005,413 | B2 | 8/2011 | Sakakibara et al. | |
| 2009/0116886 | A1 * | 5/2009 | Sakai et al. | 399/331 |
| 2011/0091252 | A1 | 4/2011 | Sekihara et al. | |
| 2011/0217092 | A1 | 9/2011 | Sekihara et al. | |
| 2011/0237413 | A1 | 9/2011 | Sakakibara et al. | |
| 2012/0014726 | A1 | 1/2012 | Sekihara et al. | |

FOREIGN PATENT DOCUMENTS

| | | | |
|---|---|---|---|
| JP | 4-44076 | A | 2/1992 |
| JP | 4-44077 | A | 2/1992 |
| JP | 4-44078 | A | 2/1992 |
| JP | 4-44079 | A | 2/1992 |
| JP | 4-44080 | A | 2/1992 |
| JP | 4-44081 | A | 2/1992 |
| JP | 4-44082 | A | 2/1992 |
| JP | 4-44083 | A | 2/1992 |
| JP | 4-204980 | A | 7/1992 |
| JP | 4-204981 | A | 7/1992 |
| JP | 4-204982 | A | 7/1992 |
| JP | 4-204983 | A | 7/1992 |
| JP | 4-204984 | A | 7/1992 |
| JP | 8-16814 | B2 | 2/1996 |
| JP | 2004-317788 | A | 11/2004 |
| JP | 2009-031772 | A | 2/2009 |
| JP | 4508692 | B2 | 7/2010 |

* cited by examiner

*Primary Examiner* — Sandra Brase
(74) *Attorney, Agent, or Firm* — Fitzpatrick, Cella, Harper & Scinto

(57) ABSTRACT

A roller for a fixing device includes a foam layer; an elastic layer containing a thermo-conductive filler and provided outside of the foam layer; a middle layer provided between the foam layer and elastic layer; wherein a content of all filler in the middle layer is smaller than a content of all filler in the elastic layer.

22 Claims, 7 Drawing Sheets

ROLLER FOR FIXING APPARATUS, AND IMAGE HEATING APPARATUS HAVING ROLLER FOR IMAGE FIXING APPARATUS

FIELD OF THE INVENTION AND RELATED ART

The present invention relates to an image heating apparatus which is suitable as a fixing apparatus (fixing device) to be mounted in an image forming apparatus such as an electrophotographic copying machine, an electrophotographic printer, and the like. It relates also to a roller to be employed by such an image heating apparatus, and the methods for manufacturing such a roller.

It has been known that if multiple sheets of recording medium, which are narrower than the widest sheet of recording medium conveyable through the fixing device of an electrophotographic printer, electrophotographic copying machine, or the like, are continuously conveyed through the fixing device with the same intervals as those for the widest sheet of recording medium, the areas of the heater of the fixing device, which are outside the recording medium path of the fixing device, excessively increasing in temperature. If the areas of the heater, which are out of the recording medium path, increases in temperature beyond a certain level, the components of the fixing device, for example, the heater holder for supporting the heater, pressure roller, and/or the like, are sometimes damaged by the heat. One of the possible methods for reducing the amount by which the out-of-recording medium-path areas of a fixing device excessively increase in temperature is to provide the pressure roller of the fixing device with a layer which is excellent in thermal conductivity. For example, Japanese Laid-open Patent Application 2009-031772 proposes a roller structured, as follows, to prevent the out-of-recording medium-path areas of the roller from excessively increasing in temperature, to make the roller reliable in recording medium conveyance, and also, to make the roller durable. More specifically, the roller is made of a core shaft, a solid rubber layer, a highly thermally conductive rubber layer, and a parting layer (surface layer). The solid rubber layer is formed on the peripheral surface of the core shaft. The highly thermally conductive layer contains carbon fiber, and is formed on the peripheral surface of the solid rubber layer. The parting layer (surface layer) is formed on the peripheral surface of the highly thermally conductive layer.

One of the possible means for improving the above described pressure roller made up of the core shaft, solid rubber layer, and higher thermally conductive layer, so that the pressure roller can be employed by a high speed printer, is to replace the solid rubber layer of the pressure roller with a foam layer, that is, a layer made of foamed substance. As one of the methods for manufacturing the pressure roller which has a foam layer in place of a solid rubber layer, it is possible to use the following one. That is, a foam layer is formed on the peripheral surface of the core shaft, and the thus formed roller is set in a mold. Then, liquid rubber is injected into the space between the roller and mold. Then, the liquid rubber is thermally cured. This method, however, turned out to be problematic in that the resultant pressure roller was extremely hard, and also, was substantially non-uniform in hardness.

Referring to FIG. 7, the following became evident: the rubber components of the liquid rubber which will become the highly thermally conductive layer 24*c* by being thermally cured, permeated into the porous cells of the foam layer 24*a*, making harder the portions of the foam layer 24*a*, into which the rubber components permeated, than the adjacent portions of the foam layer 24*a*. Further, the amount by which the rubber components permeated into the porous cells of the foam layer 24*a* was not uniform across the porous cells. Thus, the foam layer 24*a* became non-uniform in hardness.

The lower in viscosity the liquid rubber, the more likely for the liquid rubber to permeate into the porous cells of the foam layer 24*a*.

Normally, filler is mixed into the liquid rubber to increase in strength, thermal conductively, etc., the solid rubber layer, into which the liquid rubber is to be made. Fillers are different in the shape of their individual pieces. That is, some fillers are spherical in the shape of their individual pieces, whereas the individual pieces of other fillers may in the form of a needle, a platelet, or a whisker, or may be non-uniform in shape. Fillers, the individual pieces of which are in the form of a needle or a whisker are excellent in thermal conductivity, but, because of their shape, they are likely to make the liquid rubber higher in viscosity than the fillers in the other forms, as they are mixed into the liquid rubber. If the liquid rubber is higher in viscosity than a certain level, it cannot be injected into a mold.

One of the solutions to this problem is to reduce the liquid rubber itself in viscosity, which in turn makes it easier for the liquid rubber to permeate into the foam layer.

Further, regarding the state of the peripheral surface of the foam layer formed on the peripheral surface of the core shaft, the liquid rubber sometimes permeated into the foam layer regardless of whether the porous cells of the foam layer were exposed to liquid rubber at the peripheral surface of the foam layer because the peripheral surface of the foam layer was polished after the removal of the pressure roller from the mold after the formation of the foam layer, or the foam layer had a skin layer because the foam layer was left untouched (unpolished) after the removal of the pressure roller from the mold. This occurred because the skin layer had tiny holes.

The permeation of the liquid rubber into the foam layer results in the formation of a pressure roller which is unnecessarily harder and/or non-uniform in hardness, being therefore not capable of properly functioning as a pressure roller.

SUMMARY OF THE INVENTION

Thus, the primary object of the present invention is to provide a pressure roller manufacturing method that can prevent the liquid rubber, which is the material for the elastic layer for a pressure roller, from permeating into the foam layer of the pressure roller, in order to make it possible to provide a pressure roller which is uniform in hardness at a proper level, and to provide an image heating apparatus having a pressure roller manufactured with the use of the pressure roller manufacturing method in accordance with the present invention.

According to an aspect of the present invention, there is provided a roller for a fixing device, said roller comprising a foam layer; an elastic layer containing a thermo-conductive filler and provided outside of said foam layer; a middle layer provided between said foam layer and elastic layer; wherein a content of all filler in said middle layer is smaller than a content of all filler in said elastic layer.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

DESCRIPTION OF THE PREFERRED EMBODIMENTS (1) Example of Image Forming Apparatus FIG. 1 is a schematic sectional view of an example of an image forming apparatus having an image heating apparatus in accordance with the present invention, as its fixing device. It shows the general structure of the image forming apparatus. This example of an image forming apparatus is an electrophotographic laser beam printer of the so-called transfer type.

This image forming apparatus has an image forming section 17, a fixing section 6, and a control section 18 which controls the image forming section 17 and fixing section 6. The control section 18 is made up of a CPU and such memories as RAMs and ROMs, in which various image formation sequences and programs, which are necessary for image formation, are stored.

Figure 1:
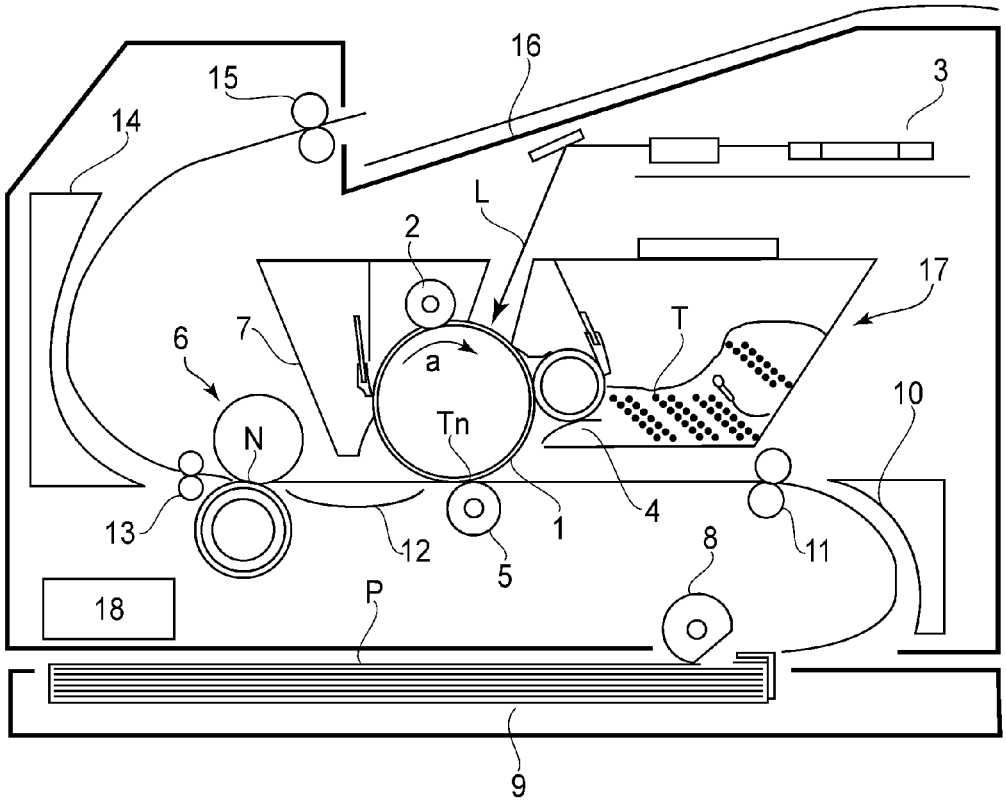
FIG. 1 is a schematic sectional view of an example of an image forming apparatus in accordance with the present invention, and shows the general structure of the apparatus.

Referring to the image forming section 17 in FIG. 1, designated by a referential code 1 is an electrophotographic photosensitive member (which hereafter is referred to simply as photosensitive drum 1), as an image bearing member, which is in the form of a rotational drum. The photosensitive drum 1 is made up of a cylindrical substrate and a photosensitive layer. The substrate is formed of aluminum, nickel, or the like. The photosensitive layer is formed of a photosensitive substance, such as OPC, amorphous Sc, amorphous Si, etc., on the peripheral surface of the cylindrical substrate. The control section 18 rotationally drives a motor (unshown) in response to the print command outputted by an external apparatus (unshown) such as a host computer, whereby the photosensitive drum 1 is rotated in the direction indicated by an arrow mark a at a preset peripheral velocity (process speed).

As the photosensitive drum 1 is rotated, a preset charge bias is applied to a charge roller 2 as a charging means, whereby the peripheral surface of the photosensitive drum 1 is uniformly charged to a preset polarity and a preset potential level.

The uniformly charged portion of the peripheral surface of the photosensitive drum 1 is exposed by a laser scanner 3. More specifically, it is scanned by the beam of laser light outputted by the laser beam scanner 3 while being modulated (turned on or off) according to the image information inputted by the external apparatus. As a result, an electrostatic latent image, which reflects the information of the image to be formed, is effected on the peripheral surface of the photosensitive drum 1.

The electrostatic latent image on the peripheral surface of the photosensitive drum 1 is developed into a visible image (image formed of toner) by a developing device 4, as a developing means, which uses toner T. The developing method used by the developing device 4 is a jumping developing method, a two-component developing method, or the like, which are frequently used in combination with the above described exposing method, and the so-called reversal developing method.

With the progression of the above described image formation process, the sheets P of recording medium, which are stored in a sheet feeder cassette 9, are sent one by one into the main assembly of the image forming apparatus by the rotation of a sheet feeder roller 8, with a preset timing. Then, each sheet P of recording medium is conveyed through the sheet passage having a guide 10, a pair of registration rollers 11, etc., and then, is conveyed to a transfer nip Tn, which is the interface between the peripheral surface of the photosensitive drum 1, and the peripheral surface of the transfer roller 5 as a transferring means. Then, the sheet P is conveyed through the transfer nip Tn while remaining pinched by the peripheral surface of the photosensitive drum 1 and the peripheral surface of the transfer roller 5. While the sheet P is conveyed through the transfer nip Tn, a preset transfer bias is applied to the transfer roller 5, whereby the toner image on the peripheral surface of the photosensitive drum 1 is transferred onto the sheet P of recording medium, and remains on the sheet P.

As the sheet P of recording medium is conveyed out of the transfer nip Tn, it is separated from the peripheral surface of the photosensitive drum 1. Then, it is introduced into a fixing apparatus 6 (fixing device) by a sheet conveyance guide 12, and is conveyed through the fixing device 6. As the sheet P is conveyed through the fixing device 6, heat and pressure is applied to the sheet P and the unfixed toner image thereon by the fixing device 6. Thus, the unfixed toner image is thermally fixed to the sheet P. The structure of the fixing device 6 will be described in detail in the subsection (2) of this section of the patent application.

After being conveyed out of the fixing device 6, the sheet P of recording medium is discharged into a delivery tray 16 through a sheet passage having a pair of sheet conveyance rollers 13, a sheet guide 14, a pair of discharge rollers 15, etc.

After the separation of the sheet P from the photosensitive drum 1, the peripheral surface of the photosensitive drum 1 is cleaned by a cleaning device 7. More concretely, the contaminants, such as the toner particles, and the like, remaining adhered to the peripheral surface of the photosensitive drum 1 are removed by the cleaning device 7 so that the peripheral surface of the photosensitive drum 1 can be repeatedly used for image formation.

This image forming apparatus is 180 mm/sec in process speed, and can handle a sheet of recording medium of a size A4, a sheet of recording medium of the letter size.

(2) Fixing Device 6 (Image Heating Device)

In the following description of the fixing device 6, the lengthwise direction of the fixing device and its structural components is the direction perpendicular to the recording medium conveyance direction. Their widthwise direction is the direction parallel to the recording medium conveyance direction. Their length is their measurement in terms of their lengthwise direction. Their width is the their measurement in terms of the direction parallel to their widthwise direction.

Figure 2:
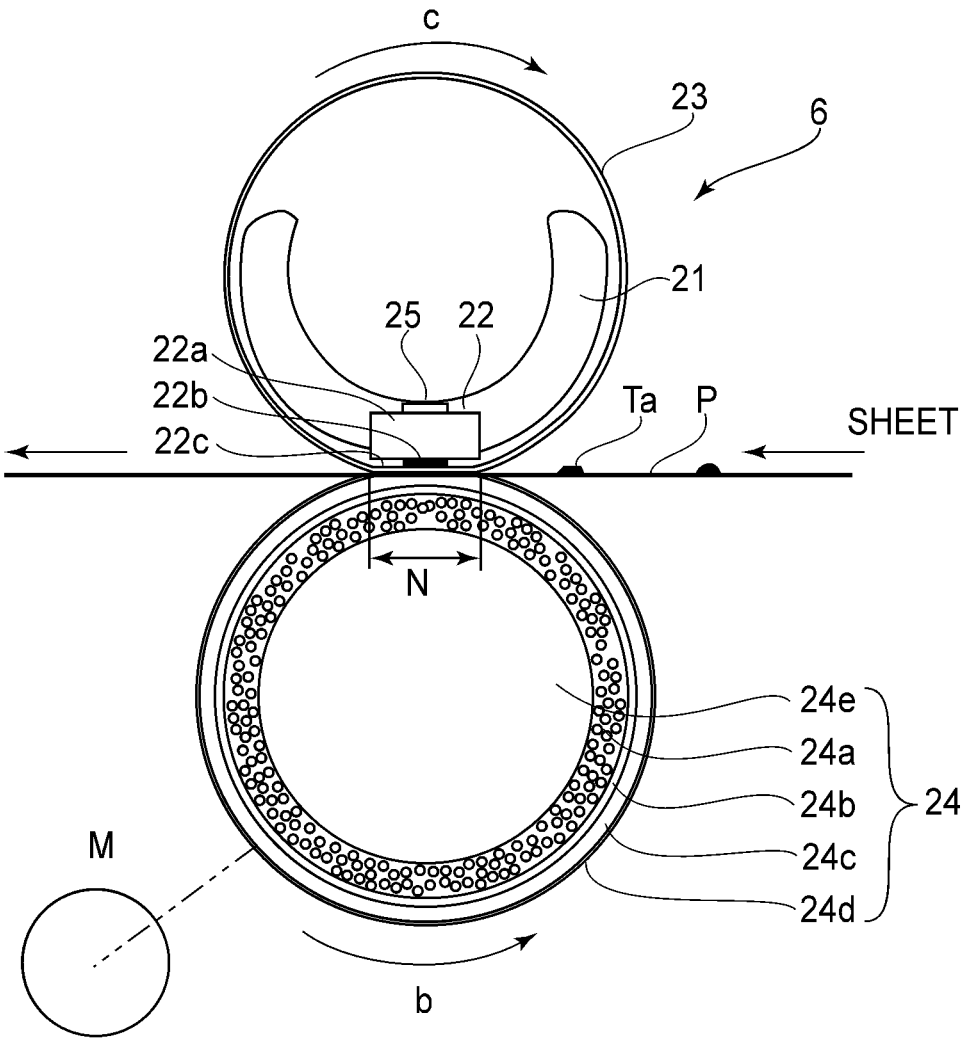
FIG. 2 is a schematic sectional view of an example of a fixing apparatus, at a vertical plane which is perpendicular to the lengthwise direction of the fixing apparatus and coincides with the lengthwise center of the fixing apparatus, and shows the general structure of the fixing apparatus.
Figure 3:
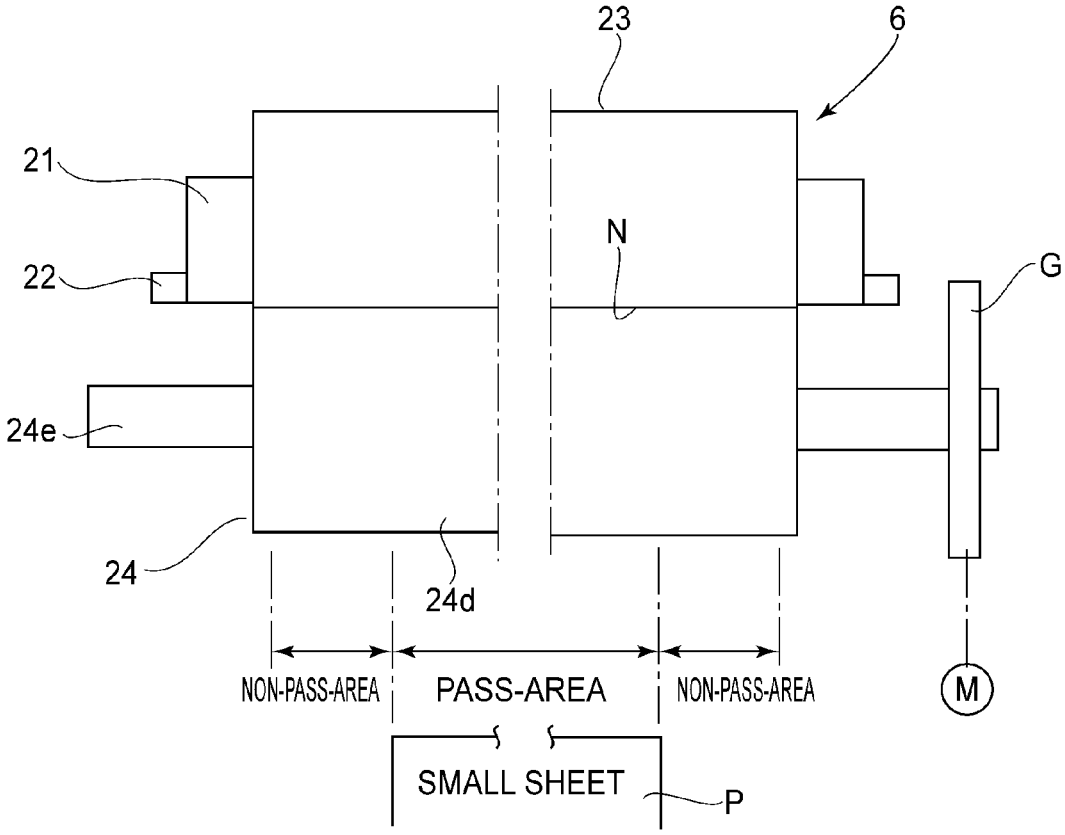
FIG. 3 is a schematic drawing for describing the sheet-path-area of the sheet passage of the fixing apparatus, and out-of-sheet-path areas of the sheet passage of the fixing device.

FIG. 2 is a schematic sectional view of the fixing apparatus 6, at a vertical plane which is perpendicular to the lengthwise direction of the fixing apparatus and coincides with the lengthwise center of the fixing apparatus. It shows the general structure of the fixing apparatus 6. FIG. 3 is a schematic drawing for describing the sheet-path-area of the recording medium passage of the fixing apparatus 6, and out-of-sheet-path areas of the recording medium passage of the fixing device 6. This fixing device 6 is the same fixing device 6 as the one disclosed in the Japanese Laid-open Patent Applications H04-44075-44083, and H04-204980-204984, etc. That is, it is made up of a tensionless heating film and a pressure roller, and is structured so that the pressure roller is driven.

This fixing device 6 has: a film guide 21 as a supporting member; a ceramic heater 22 (which hereafter is referred to simply as heater 22) as a heating member; a heat resistant fixation film 23 as a flexible member (endless belt); a pressure roller 24 as a pressure applying member; etc. The film guide 21, heater 22, fixation film 23, and pressure roller 24 are shaped so that their lengthwise direction coincides with the lengthwise direction of the fixing device 6. The fixation film 23, heater 22, film guide 21, etc., of the fixing device 6 make up the heating unit of the fixing device 6.

The film guide 21 is a component molded of heat resistant resin such as PPS (polyphenylene sulfate), liquid polymer, and the like. It is roughly semicircular in cross section. This film guide 21 is supported by the frame (unshown) of the fixing device 6, by its lengthwise ends. The fixing device 6 is also provided with the heater 22, which is supported by the film guide 21. More specifically, the bottom surface of the film guide 21 is provided with a groove 21*a*, which is roughly at the center of the film guide 21 in terms of the widthwise direction of the film guide and extends in the lengthwise direction of the film guide 21. The heater 22 is in the groove 21*a*. The fixation film 23, which is cylindrical, is loosely fitted around the film guide 21 which supports the heater 22.

The heater 22 is made up of a substrate 22*a*, a heat generating resistor 22*b*, and a surface protection layer 22*c*. The substrate 22*a* is long and narrow, and is formed of ceramic such as alumina. The heat generating resistor 22*b* is on the surface of the substrate 22*a*, which faces the inward surface of the fixation film 23. It is in the form of a piece of wire, or a long and narrow piece of plate, and is formed of Ag/Pb. It extends in the lengthwise direction of the substrate 22*a*. It is formed by printing. The surface protection layer 22*c* is formed of glass of the like substance, and covers the heat generating resistor 22*b*. The fixation film 23 is desired to be small in thermal capacity so that it can be quickly heated. Thus, it is made to be no more than 100 μm, preferably in a range of 20 μm-60 μm, in overall thickness. It has a cylindrical base film (unshown), which is heat-resistant, excellent in parting properties, strong, and durable. As the material for the base film of the fixation film 23, single-layer film made of PTFE (polytetrafluoroethylene), PFA (perfluoroalkoxy), PPS, or the like, may be used. Further, it may be multilayer film. For example, it may be double-layer film made by coating the base film formed of polyimide, polyamide-imide, PEEK, PES, or the like, with PTFE, PFA, FEP, or the like, as the parting layer material. "PEEK" is an abbreviation of polyether-ether-ketone, and "PES" is an abbreviation of polyethersulfone. "PTFE, PFA and FEP" are abbreviations of polytetrafluoroethylene, perfluoroalkoxy, and fluorinated ethylene-propylene.

The pressure roller 24 is under the fixation film 23, and is positioned so that it faces the heater 22. It has a metallic core 24*e*, a foam layer 24*a*, a barrier layer 24*b* (intermediary layer), an elastic solid rubber layer 24*c*, a parting layer 24*d*, etc. The metallic core 24*e* is made of such material as iron and aluminum. The parting layer 24*d* is made of such a substance as fluorinated resin. The materials for the foam layer 24*a*, barrier layer 24*b*, and elastic solid rubber layer 24*c*, and the manufacturing methods therefor, are described layer in detail. The pressure roller 24 is rotatably supported by the frame of the fixing device 6, by the lengthwise ends of its metallic core 24*e* (which hereafter may referred to simply as core shaft 24*e*), with the presence of a pair of bearings (unshown) between the frame and the lengthwise ends of the core shaft 24*e* (metallic core 24*e*). Further, the pair of bearings by which the lengthwise ends of the metallic core 24*e* are borne one for one are kept pressed toward the fixation film 23 (heater 22) by a pair of compression springs (unshown). Thus, the pressure roller 24 is kept pressed against the surface protection layer 22*c* of the heater 22, with the presence of the fixation film 23 between the pressure roller 24 and surface protection layer 22*c*, whereby the elastic layer 24 is elastically deformed, forming thereby a fixation nip N, which has a preset width, between the peripheral surface of the pressure roller 24 and the outward surface of the fixation film 23.

Next, the thermal image fixation operation of the fixing device 6 in this embodiment is described. The control section 18 turns on the electric power supply circuit in response to a print command, whereby electric power is flowed through the heat generating resistor 22*b* of the heater 22 by the power supply circuit. As the power is flowed through the heat generating resistor 22*b*, the resistor 22*b* generates heat and quickly increases in temperature, heating therefore the fixing film 23. The temperature of the heater 22 is detected by a temperature detection element, as a temperature detecting member, provided on the surface of the heater substrate 22*a*, which faces the heater holder 21. The temperature detection element 25 outputs the detected temperature of the heater 22 to the control section 18, which controls the power supply circuit, based on the detected temperature of the heater 22, so that the temperature of the heater 22 is maintained at a preset fixation level (target level). The fixation temperature level in this embodiment is set to 170° C.

Further, the control section 18 rotationally drives a motor (unshown) in response to the print command. The rotation of the output shaft of this motor is transmitted, through a gear train (unshown), to a driving gear G (FIG. 3), with which one of the lengthwise ends of the core shaft 24*e* of the pressure roller 24 is provided. Thus, the pressure roller 24 rotates in the direction indicated by an arrow mark b. The rotation of the pressure roller 24 is transmitted to the outward surface of the fixation film 23 by the friction generated between the peripheral surface of the pressure roller 24 and the outward surface of the fixation film 23 in the fixation nip N. Thus, the fixation film 23 follows the rotation of the pressure roller 24, circularly moving thereby in the direction indicated by an arrow mark c. While the pressure roller 24 is rotated, and the temperature of the heater 22 is kept at the fixation level, a sheet P of recording medium, on which an unfixed toner image Ta is present, is introduced into the fixation nip N, with the toner image bearing surface of the sheet P facing the upward. Then, the sheet P is conveyed through the fixation nip N while remaining pinched by the outward surface of the fixation film 23 and the peripheral surface of the pressure roller 24. While the sheet P is conveyed through the fixation nip N, the toner image Ta on the sheet P is subjected to the heat from the fixation film 23 and the pressure in the fixation nip N. As a result, the toner image Ta is thermally fixed to the sheet P. After the thermal fixation of the toner image Ta to the sheet P of recording medium, the sheet P is separated from the outward surface of the fixation film 23, and is discharged from the fixation nip N.

A fixing device, such as the fixing device 6, which is of the so-called heating film type, can use a heater such as the heater 22 which is small in thermal capacity, and therefore, quickly increases in temperature. In other words, a fixing device of the so-called heating film type is significantly shorter in the length of time it takes for its temperature to reach the fixation level than a fixing device which does not employ a heating film. That is, it can be easily started up for fixation even when its temperature is the same as the ambient temperature. Therefore, when the fixing device 6 is kept on standby during a printing operation, its temperature does not need to be kept at a preset standby level. Therefore, it is substantially smaller in power consumption compared to a fixing device of the other type.

Further, the circularly movable fixation film 23 is under practically no tension except in the fixation nip N. Thus, all that is necessary to prevent the fixation film 23 from deviating in its lengthwise direction is to provide the fixing device 6 with a pair of flanges (unshown), as a film deviation regulating means, which simply catch the fixation film 23 by the lengthwise edges of the film 23.

(3) Pressure Roller 24

Next, the pressure roller 24 of the fixing device 6 is described in detail about its materials, method for molding the pressure roller 24, etc.

3-1) Laminar Structure of Pressure Roller 24, and Manufacturing Method for Pressure Roller 24

Figure 4:
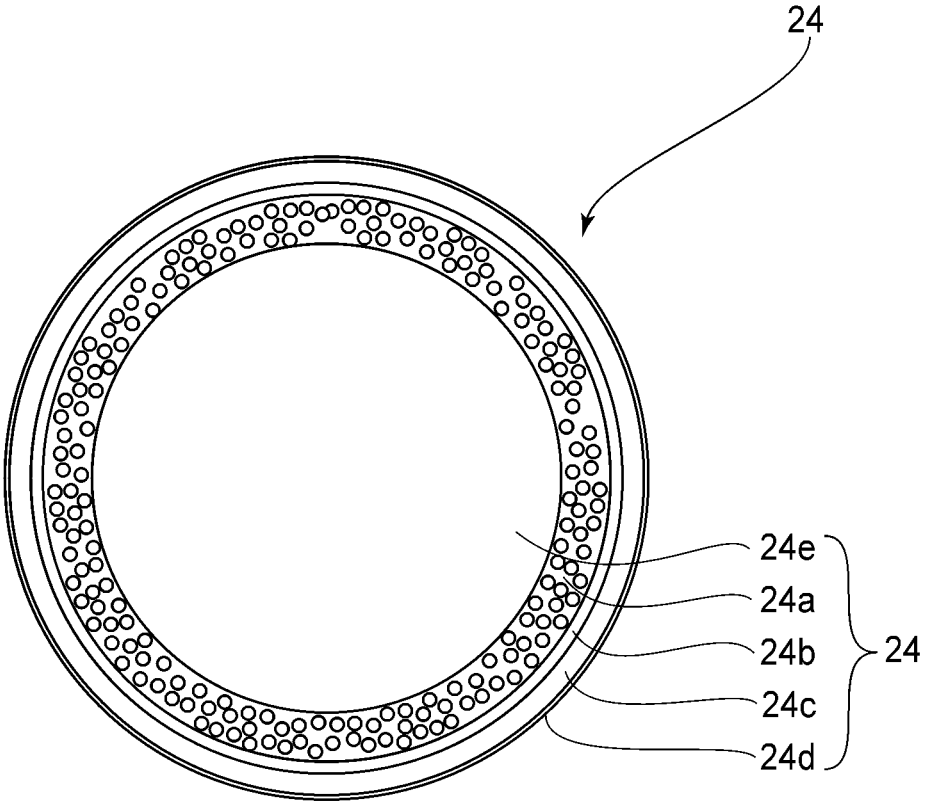
FIG. 4 is a schematic sectional view of the pressure roller, at a plane perpendicular to the lengthwise direction of the roller, and shows the general structure of the pressure roller.
Figure 8:
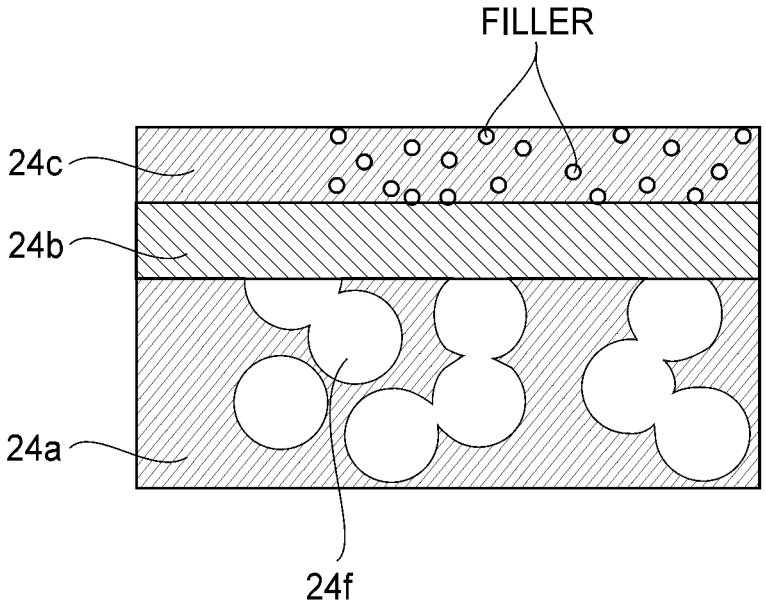
FIG. 8 is a schematic drawing for describing the state of the pressure roller, in which the intermediary layer between the foam layer and highly thermally conductive layer of the pressure roller is preventing the liquid rubber, which will become the highly thermally conductive layer, from permeating into the porous cells of the foam layer.

FIG. 4 is a schematic cross-sectional view of the pressure roller 24, and shows the structure of the pressure roller 24. FIG. 8 is an enlarged schematic drawing of the foam layer 24*a*, barrier layer 24*b*, and elastic solid rubber layer 24*c* of the pressure roller 24.

The pressure roller 24 is made up of a metallic core 24*e* (which hereafter may be referred to as core shaft 24*e*), and at least the following layers 24*a*, 24*b*, 24*c* and 24*d* layered in the listed order on the peripheral surface of the metallic core 24*e*.

a: foam layer 24*a* formed of an elastic (soft) and heat-resistant substance such as silicone rubber.

b: barrier layer 24*b* (intermediary layer) formed of silicone rubber or fluorinated rubber to prevent liquid rubber, which will become the elastic solid rubber layer 24*c* as it is cured, from permeating into the porous cells 24*f* (which hereafter may be referred to as foam cells).

c: elastic solid rubber layer 24*c* formed of a material made by mixing thermally conductive filler into such rubber as silicone rubber which is elastic (soft) and heat-resistant.

d: parting layer 24*d* formed on the peripheral surface of the elastic solid rubber layer 24*c*, of such a substance as fluorinated resin or fluorinated rubber.

The foam layer 24*a* is provided to make the pressure roller 24 as adiabatic as possible to reduce the pressure roller 24 in warm-up time. The elastic solid rubber layer 24*c* is provided to make the pressure roller 24 as good as possible in thermal conductivity in terms of the lengthwise direction of the pressure roller 24, in order to prevent the out-of-sheet-path portions of the pressure roller 24 from becoming significantly higher in temperature than the sheet path portion of the pressure roller 24.

3-1-1) Foam Layer 24*a*, and Manufacturing Method for Foam Layer 24*a*

The foam layer 24*a* is formed of a foamed substance as described above, and therefore, functions as an adiabatic layer for minimizing the amount of heat dissipation from the pressure roller 24 to reduce the fixing device 6 in warm-up time.

The overall thickness of the elastic layer (24*a*+24*b*+24*c*) of the pressure roller 24 does not need to be limited to a specific value, as long as it enables the pressure roller 24 to form the fixation nip N having a preset width in terms of the recording medium conveyance direction. However, it is desired to be in a range of 2-10 mm. In particular, the foam layer 24*a* is not to be limited in thickness to a specific value. It has only to be adjust in thickness as necessary according to the thickness and/or hardness of the elastic solid rubber layer 24*c*, which will be described in detail in Subsection 3-1-3). The following are the preferable substances as the base material for the foam layer 24*a*.

For example, high temperature vulcanization silicon (HTV), addition reaction curable silicone rubber (LTV), room temperature vulcanization silicone rubber (RTV), fluorinated rubber, and mixtures of preceding rubbers, can be listed. More concretely, such silicone rubbers as dimethyl silicone rubber, fluorosilicone rubber, methyl phenyl silicone rubber, etc., can be used. Further, fluorinated rubber such as fluorovinylidene rubber, tetrafluoroethylene-propylene rubber, tetrafluoroethylene-perfluoromethylvinylether rubber, phosphagenfluororubber, fluorinated polyether, etc., can be used. These rubbers may be used by themselves, or in combination of two or more.

A list of spherical hollow filler (which hereafter may be referred to simply as hollow filler) which can be mixed into the base material for the aforementioned foamed layer 24*a* of the pressure roller 24 to make the pressure roller 24 adiabatic to a proper degree is as follows: glass balloon, silica balloon, carbon balloon, phenol resin balloon, vinylidene chloride resin balloon, acrylonitrile resin balloon, balloon formed of copolymer of vinylidene chloride and (metha)acrylonitrile, alumina balloon, zirconia balloon, silas balloon, etc.

The amount by which hollow filler is mixed into the base material, such as silicone rubber, for the foam layer 24*a* is roughly 0.5-30 parts, preferably, 1.0-20 parts, to 100 parts of the base material by weight. If it is smaller than a certain value, the pressure roller 24 does not become satisfactorily low in thermal conductivity. Therefore, it is impossible to provide a fixing device which is satisfactorily short in startup time. Therefore, it is undesirable that the amount is smaller than a certain value. On the other hand, if the amount by which hollow filler is mixed into the base material for the foam layer 24*a* is greater than a certain value, it is difficult to uniformly mix the filler into the base material, and also, the foam layer 24*a* will be unsatisfactory in strength. Therefore, it is undesirable that the amount is larger than a certain value. Further, for the same reason given above, the amount in volume ratio by which hollow filler is mixed into the base material for the foam layer 24*a* is desired to be in a range of 10-80%, in particular, 15-75%, relative to the foam layer material (combination of the base material (rubber) and filler) .

The spherical hollow filler is dispersed in the abovementioned base material for the foam layer 24*a*. Then, the mixture is coated on the peripheral surface of the core shaft 24*e*, and formed into the foamed layer 24*c*, with the use of one of the known methods such as injection molding and ring coating. Then, the core shaft 24*e* covered with the foam layer 24*a* is removed from the mold after the foamed layer 24*a* is thermally cured.

Instead of the spherical hollow filler, water-absorbent polymer soaked with water may be dispersed in the silicone rubber (base material), so that when the silicone rubber (base material) is thermally cured, the water in the water-absorbent polymer evaporates into steam, and forms foams (cells) in the elastic silicone rubber layer.

As water-absorbent polymer, (metha)acrylic acid, polymer of alkaline metallic salt, copolymer or cross-linked combinations among the preceding substances, graft copolymer of starch and (metha)acrylic acid, and the alkali metallic salts of the graft copolymer, etc., can be listed. For better results, polyacrylic acid, and its alkali metallic salt, cross-linked combination of them, graft copolymer of starch and acrylic acid and its alkali metallic salt are preferable. In particular, cross-linked partial sodium salt of acrylic acid and partial sodium salt of graft copolymer of starch and acrylic acid are preferable.

Also in this case, the water-absorbent polymer soaked with water is dispersed in the abovementioned base material for the foam layer 24*a*. Then, the mixture is coated on the peripheral surface of the core shaft 24*e*, and formed into the foamed layer 24*c*, with the use of one of the known methods such as injection molding and ring coating. Then, the core shaft 24*e* covered with the foam layer 24*a* is removed from the mold after the foamed layer 24*a* is thermally cured.

Further, the base material for the foamed layer 24*a* may be made to foam with the use of a foaming agent instead of water.

There is little restriction regarding the foaming agent choice. For example, ammonium carbonate, ammonium bicarbonate, sodium bicarbonate, nitroso compound, azo compound, sulfonyl hydrozide, etc., may be used.

Also in a case where one of the abovementioned foaming agents is used, all that is necessary to form the foamed layer 24*a* is that the foaming agent is mixed into the base material for the foamed layer 24*a* by a preset amount, and the foamed layer 24*a* is formed on the peripheral surface of the core shaft 24*e* with the use of one of the known methods, such as extrusion molding, injection molding, ring coating, etc.

With regard to the structure of the foamed layer 24*a*, the cells of the foamed layer 24*a* may be independent or continuous. Further, the cells of the foamed layer 24*a* may be a mixture of the independent ones and continuous ones. From the standpoint of preventing the liquid rubber, which is the material for the elastic solid rubber layer 24*c*, from permeating into the foamed layer 24*a*, the foam cells in the foamed layer 24*a* are desired to be independent from each other.

Further, the peripheral surface of the foamed layer 24*a* may be provided with a skin layer, or simply polished. From the standpoint of preventing the liquid rubber from permeating into the foamed layer 24*a*, however, providing the peripheral surface of the foamed layer 24*a* with a skin layer is preferable.

3-1-2) Barrier Layer 24*b* (Intermediary Layer), and Method for Manufacturing Barrier Layer 24*b*

The barrier layer 24*b* functions as a layer for filling the cells of the foamed layer 24*a*, or minute passages leading to the cells, to prevent the liquid rubber, which is the material for the elastic solid rubber layer 24*c*, from permeating into the foamed layer 24*a*.

There is no specific requirement for a substance to be used as the material for the barrier layer 24*b*. All that is required thereof is that it is capable of preventing the liquid rubber, which is the material for the elastic rubber layer 24*c*, from permeating into the foamed layer 24*a*; it is flexible; and it is desirably adherent to the foamed layer 24*a* and elastic solid rubber layer 24*c*. In view of the fact that it is required to be easily moldable, and also, heat-resistant, it is desired to be silicone rubber or fluorinated resin.

More concretely, as the material for the barrier layer 24*b*, unadulterated liquid silicone rubber or fluorinated rubber (material for base material of foamed layer 24*a* described in sub-section 3-1-1), liquid silicone rubber or liquid fluorinated rubber obtained by diluting unadulterated liquid silicone rubber or liquid fluorinated rubber with xylene or the like solvent, and paint made of silicone rubber or fluorinated rubber can be used. As for the method for forming the barrier layer 24*b*, the barrier layer 24*b* is formed by coating, with the aforementioned unadulterated liquid, the peripheral surface of the foamed layer 24*a* formed on the peripheral surface of the core shaft 24*e*, and also, both the lengthwise end surfaces of the foamed layer 24*a*, by a known method, such as spraying, dipping, brushing, or the like method, which does not apply high pressure upon the foamed layer 24*a*. After the formation of the barrier layer 24*b* on the peripheral surface of the foamed layer 24*a*, the barrier layer 24*b* is dried or thermally cured.

It is possible that the liquid rubber will reach the elastic solid rubber layer 24*c* through the joints of the pressure roller formation mold. Therefore, it is desired that the barrier layer 24*b* is also formed on the lengthwise end surfaces of the foamed layer 24*a* after the formation of the foamed layer 24*a* on the peripheral surface of the core shaft 24*e*.

The barrier layer 24*b*, which is formed of silicone rubber, fluorinated rubber, or the like, is relatively hard, that is, high in bridge density. The higher in bridge density the barrier layer 24*b*, the better from the standpoint of preventing the liquid rubber, which is the material for the elastic solid rubber layer 24*c*, from permeating into the foamed layer 24*a*. More concretely, it is desired that silicone rubber or fluorinated rubber, whose test piece is no less than 30° in hardness (JIS Hardness Scale A), is used as the material for the barrier layer 24*b*.

As for the thickness of the barrier layer 24*b*, the barrier layer 24*b* has only to be formed thick enough to prevent the liquid rubber, as the material for the elastic solid rubber layer, from permeating into the foamed layer 24*a*, although the thickness has to be determined according to the choice of the material for the barrier layer 24*b*. However, the thickness of the barrier layer 24*b* has negative effects upon the adiabatic nature of the foam layer 24*a* and the high thermal conductivity of the elastic solid rubber layer 24*c*. Therefore, it is not desirable for the barrier layer 24*b* to be formed unnecessary thick. That is, the barrier layer 24*b* is desired to be no less than 15 μm and no more than 500 μm, preferably, no less than 20 μm and no more than 100 μm, in thickness.

For the purpose of obtaining a barrier layer (24*b*) which is higher in thermal conductivity, stronger, more attractive in color, higher in electrical conductivity, lower in cost, etc., filler may be added to the base material for the barrier layer 24*b* as necessary. The greater the amount by which filler is mixed (dispersed) into the liquid rubber, the higher in viscosity the resultant mixture of the liquid rubber and filler. However, the viscosity of the mixture of the liquid rubber and filler affects the pressure roller manufacturing process, in operational efficiency, and the like. Therefore, it is not desirable for the mixture to be higher in viscosity than a certain value. In other words, if it is desired to increase the amount by which filler is added to the base material for the barrier layer 24*b*, silicone rubber, fluorinated rubber, or the like, which is low in viscosity, has to be selected as the base material for the barrier layer 24*b*. On the other hand, if the liquid rubber, as the material for the barrier layer 24*b*, is lower in viscosity than a certain value, the liquid rubber permeates into the cells of the foam layer 24*a*, the wall of which is porous. Thus, the filler content (ratio of filler relative to entirety of barrier layer 24*b*) of the barrier layer 24*b* (intermediary layer) is desired to be smaller than the filler content (ratio of all filler (including filler other than thermally conductive filler), relative to entirety of elastic layer 24*c*) of the elastic layer 24*c* which contains thermally conductive filler. More concretely, the filler content of the liquid rubber (as base material for barrier layer 24*b*) is desired to be no more than 10 vol. %. Incidentally, the barrier layer 24*c* may be formed without filler.

3-1-3) Elastic Solid Rubber Layer 24*c*, Method for Manufacturing Elastic Solid Rubber Layer 24*c*, and Method for Measuring Thermal Conductivity of Elastic Solid Rubber Layer 24*c*

The elastic solid rubber layer 24*c* is on the barrier layer 24*b*, and is roughly uniform in thickness. It functions as a layer for improving the pressure roller 24 in the thermal conductivity in its lengthwise direction, in order to prevent the out-of-sheet-path portions of the pressure roller 24 from increasing in temperature.

The thickness of the elastic solid rubber layer 24*c* is optional. That is, all that is necessary is that the overall thickness of the elastic solid rubber layer 24*c* is within the range described in the subsection 3-1-1), which enables the pressure roller 24 to properly function as a pressure applying means.

The resulting elasticity of the elastic solid rubber layer 24*c* can be adjusted by adjusting its base material in degree of cross-linking, according to the type of the thermally conductive filler (which hereafter may be referred to simply as filler) and the amount by which filler is added to the base material of the elastic solid rubber layer 24*c*. Therefore, the material for the elastic solid rubber layer 24*c* is desired to be addition reaction cure silicone rubber.

Generally speaking, addition-polymer silicone rubber contains organopolysiloxane having an unsaturated aliphatic group, organosiloxane having activated hydrogen bonded to silicone, and a platinum compound as cross-linking catalyst.

The elastic solid rubber layer 24*c* contains thermally conductive filler which is for improving the pressure roller 24 in the thermal conductivity in terms of the lengthwise direction of the pressure roller 24.

The thermally conductive filler to be mixed into the base material for the elastic solid rubber layer 24*c* in order to provide an elastic solid rubber layer 24*c* which is highly thermally conductive is desired to be highly thermally conductive. More concretely, an inorganic substance, in particular, a metallic substance, a metallic compound, or the like substance can be listed as the filler.

The examples of the highly thermally conductive filler include the following: silicone carbonate (SiC), silicone nitrate ($Si_3N_4$), boron nitrate (BN), aluminum nitrate (AlN), alumina ($Al_2O_3$), zinc oxide (ZnO), magnesium oxide (MgO), silica ($SiO_2$), copper (Cu), aluminum (Al), silver (Ag), iron (Fe), nickel (Ni), carbon (C), etc.

These substances can be used alone, or in a mixture of two or more. From the standpoint of handling and dispersibility, the average particle diameter of the highly thermally conductive filler is desired to be no less than 1 μm and no more than 200 μm.

As for the shape of the highly thermally conductive filler, the filler may be spherical, needle-like, plate-like, whiskery, or may be non-uniform in shape. From the standpoint of dispersibility, however, it is desired to be spherical, but from the standpoint of thermal conductivity, it is desired to be whiskery.

However, if needle-like filler or whiskery filler is mixed into the base material of the base material of the elastic solid rubber layer 24*c* by no less than 40% in volume, the base material, or the rubber, becomes excessively high in viscosity, becoming thereby difficult to mold, because of the filler shape. Therefore, when needle-like filler or whiskery filler is used as the filler for the elastic solid rubber layer 24*c*, the amount by which the filler is mixed into the base material for elastic solid rubber layer 24*c* is desired to be no less than 50% and no more than 40% in volume.

Needle-like filler and whiskery filler are different from other fillers in that the relationship between the amount by which they are mixed into the base material for the elastic solid rubber layer 24*c*, and the thermal conductivity of the resulting elastic solid rubber layer 24*c* is such that as the amount by which they are mixed into the base material for the elastic solid rubber layer 24*c* is increased beyond a certain value, the thermal conductivity of the resulting elastic solid rubber layer 24*c* is non-proportionally high relative to the amount of the filler in the elastic solid rubber layer 24*c*. The reason for this phenomenon is as follows. That is, as the amount by which the needle-like filler or whiskery filler is mixed into the base material for the elastic solid rubber layer 24*c* exceeds a certain value, the fibers of the needle-like filler, or the fibers of the whiskery filler, touch each other, and therefore, heat conduction passages are formed. This is why the amount by which the needle-like filler or whiskery filler is mixed into the base material for elastic solid rubber layer 24*c* is desired to be no less than 15% and no more than 40% in volume, from the above described standpoint.

As described above, the filler made up of needle-like fibers, and filler made up of whiskery fibers is more likely to form heat conduction passages than the filler made up of fibers which are not needle-like or whiskery. Therefore, they have such a characteristic that the amount by which they are to be mixed into the base material for elastic solid rubber layer 24*c* to increase elastic solid rubber layer 24*c* in resulting thermal conductivity does not need to be as large as the amount by which fillers other than the needle-like or whiskery filler are to be mixed.

Further, as needle-like filler or whiskery filler is dispersed into the addition reaction cure silicone rubber before curing, their fibers are likely to align in the direction parallel to the direction in which the addition-polymer silicone rubber flows when the elastic solid rubber layer 24*c* is molded, that is, the direction parallel to the lengthwise direction of the pressure roller 24 (which hereafter may be referred to simply as roller shaft direction). Therefore, needle-like filler or whiskery filler can increase the elastic solid rubber layer 24*c* in thermal conductivity in terms of the roller shaft direction.

In order for the needle-like fibers or whiskery fibers in the filler to be effective in increasing the elastic solid rubber layer 24*c* in thermal conductivity by being aligned in the lengthwise direction of the roller, they have to be no less than 5 in aspect ratio (fiber length/fiber diameter), and are desired to be no less than 50 μm in length. If the filler is no less than 1 mm in fiber length, the mixture of the base material for elastic solid rubber layer 24*c* and filler is extremely difficult to process.

For the purpose of increasing elastic solid rubber layer 24*c* in the thermal conductivity in terms of the lengthwise direction, such needle-like filler or whiskery filler that is no less than 500 W/(m·k) in thermal conductivity in terms of the lengthwise direction of the fiber is desirable. The thermal conductivity A of the filler was measured by a laser flash method, with the use of a Laser Flash Method Thermal Constant Measuring System (TC-7000: product of ULVAC- RIKO, Inc.). The filler which is no more than 500 V/(m·k) in thermal conductivity is less effective to reduce the amount by which the out-of-sheet-path portions of the pressure roller 24 unwantedly increases in temperature.

From the standpoint of thermal conductivity, pitch-based carbon fiber is preferable among needle-like fillers and whiskery fillers.

The thermal conductivity of the elastic solid rubber layer 24*c* in terms of the lengthwise direction of the pressure roller 24 is desired to be no less than 2.0 W/(m·k), above which the elastic solid rubber layer 24*c* is significantly more effective to reduce the amount by which the out-of-sheet-path portions of the pressure roller 24 unwantedly increase in temperature. Described next is the method for measuring the thermal conductivity of the elastic solid rubber layer 24*c*.

The thermal diffusivity $\alpha$ ($m^2/s$) of the elastic solid rubber layer 24*c* in the roller shaft direction can be measured by a Laser PIT (commercial name: product of Ulvac-Riko, Inc.). In order for the elastic solid rubber layer 24*c* to be measured in thermal diffusivity $\alpha$, a 0.5 mm thick piece of elastic solid rubber layer 24*c* was cut out as a test piece from the elastic solid rubber layer 24*c*.

Further, the specific heat Cp (J/(k·kg)) of the elastic solid rubber layer 24*c* was measured with a differential scanning calorimeter DSC823c (commercial name: product of Mettler Taledo Co., Ltd.). Further, the density $\rho$ ($kg/m^3$) of the elastic solid rubber layer 24*c* was measured with a dry densitometer Accupyc 1330 (commercial name: product of Micromeritics Co., Ltd.). Then, the thermal conductivity of the elastic solid rubber layer 24*c* was obtained from Equation 1 given below:

$$\lambda=\alpha\times\rho\times Cp \quad (1).$$

3-1-4) Parting Layer 24*d*

As the material for the parting layer 24*d*, a piece of tube molded of one of the following list of fluorinated resins is used, or paint made of one of the following list of fluorinated resins, is used:

Copolymer (PFA) of tetrafluoroethylene-perfluoroalkylvinylether, polytetrafluoroethylene (PTFE), copolymer (FEP) of tetrafluoroethylene and ahexafluoropropylene, and the like.

From the standpoint of moldability, and separability from toner, PFA is preferable among the above given list of materials.

From the standpoint of strength and processability, a piece of tube made of fluorinated resin is preferable as the material for the parting layer 24*d*.

The fluorinated resin tube is desired to be no more than 100 μm in thickness. Being less than 100 μm in thickness, it allows the elastic solid rubber layer 24*c*, that is, the layer immediately under the fluorinated resin tube (parting layer 24*d*), to remain elastic after its fitting around the peripheral surface of the elastic solid rubber layer 24*c* formed on the core shaft 24*e*, and also, can prevent the pressure roller 24 becoming too much in surface hardness after being fitted with the fluorinated resin tube.

The inward surface of the fluorinated resin tube may be treated in advance with sodium, ammonia, or the like, or processed with an excimer laser to improve the rubber in adhesiveness.

There is no restriction about the method for covering the peripheral surface of the elastic solid rubber layer 24*c* with the fluorinated resin tube. One of the available methods is as follows. That is, after the partially finished pressure roller 24 is removed from the pressure roller formation mold after the formation of the elastic solid rubber layer 24*c*, the fluorinated resin tube is fitted around the elastic solid rubber layer 24*c*, using addition-polymer silicone adhesive as lubricant. Another method is to fit the fluorinated resin tube around the elastic solid rubber layer 24*c* while keeping the fluorinated resin tube externally expanded in its diameter direction.

Further, the parting layer 24*d* may be formed on the peripheral surface of the elastic solid rubber layer 24*c* by coating the peripheral surface of the elastic solid rubber layer 24*c* with fluorinated resin.

Figure 5:
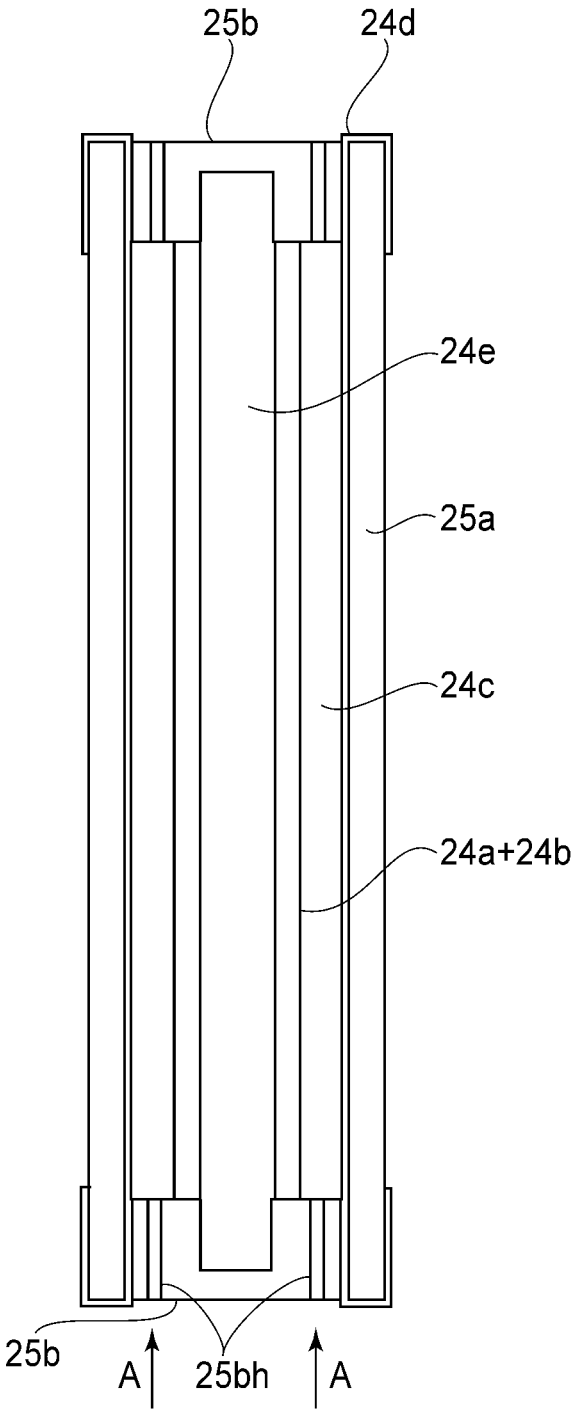
FIG. 5 is a schematic sectional view of the pressure roller, at a plane which is parallel to the lengthwise direction of the roller and coincides with the axial line of the roller, and is for showing one of the methods for manufacturing the pressure roller.

The methods other than the abovementioned ones, which are usable to cover the peripheral surface of the elastic solid rubber layer 24*c* with fluorinated resin tube are as follow (FIG. 5):

- Place fluorinated resin tube 24*d* in the cylindrical mold so that the entirety of the peripheral surface of the tube 24*d* is in contact with the inward surface of the mold.
- Form the foam layer 24*a* on the peripheral surface of the core shaft 24*e*; form the barrier layer 24*b* on the peripheral surface of the foam layer 24*a*; place the combination of the core shaft 24*e*, foam layer 24*a*, and barrier layer 24*c* in the fluorinated resin tube 24*d* in the pressure roller formation mold 25*a* so that the axial line of the core shaft 24*e* coincides with the axial line of the pressure roller formation mold 25*a*.
- Inject liquid addition-polymer silicone rubber which contains highly thermally conductive filler into the space between the barrier layer 24*b* and fluorinated resin tube 24*d* in the direction parallel to the axial line of the pressure roller formation mold 25*a* (direction indicated by arrow mark A in FIG. 5). Since the thermoset liquid addition-polymer silicone rubber which contains higher thermally conductive filler is to be injected into the abovementioned space in the direction parallel to the axial line of the mold 25*a*, the pair of end pieces 25*b* of the mold 25*a* are provided with a hole 25*bh* through which the silicon rubber compound is flowed into the mold 25*a*.
- Cure the thermoset liquid addition-polymer silicone rubber compound in the mold 25*a* by heating, and remove the finished pressure roller 24 from the mold 25*a*.

Further, a primer layer or an adhesive layer may be formed between the adjacent two layers among aforementioned layers of the pressure roller 24 (foam layer 24*a*, barrier layer 24*b*, elastic solid rubber layer 24*c*, and parting layer 24*d*) for better adhesion and electrical conductivity. In a case where a primary layer or an adhesive layer is placed between the foam layer 24*a* and barrier layer 24*b*, it is the peripheral surface of the foamed layer 24*a* that is to be treated with primer. In a case where a primary layer or an adhesive layer is formed between the barrier layer 24*b* and elastic solid rubber layer 24*c*, it is the peripheral surface of the barrier layer 24*b* that is to be treated with primer. That is, the peripheral surface of at least one of the foam layer 24*a* and barrier layer 24*b* is treated with primer. Further, in a case where a primary layer or an adhesive layer is formed between the elastic solid rubber layer 24*c* and parting layer 24*d*, it is the peripheral surface of the elastic solid rubber layer 24*c* that is to be treated with a preselected primer.

The material for each layer among the aforementioned layers of the pressure roller 24 (foam layer 24*a*, barrier layer 24*b*, elastic solid rubber layer 24*c*, and parting layer 24*d*) is to be selected from among the dielectric substances, and electrically conductive substances which have been adjust in electrical resistance, according to the amount of electrical resistance of which each layer is required.

Each of the foam layer 24*a*, barrier layer 24*b*, and elastic solid rubber layer 24*c* may have two or more sublayers, as long as they are layered on the peripheral surface of the core shaft 24*e* in the listed order.

Further, the pressure roller 24 may be provided with layers, other than the above described one, which are placed between the adjacent two layers, or on the peripheral surface of the pressure roller 24, to further improve the pressure roller 24 in slipperiness, heat generation, parting, and the like properties. The order in which these layers of the pressure roller 24 are to be formed does not need to be specific; it may be changed as necessary according to what is required of the process for forming each of these layers.

EMBODIMENTS

In order to confirm the effects of the pressure rollers in accordance with the present invention, the pressure rollers 24 in the first to ninth embodiments of the present invention, and examples of comparative pressure rollers 24, were measured in hardness, and their non-uniformity in hardness were obtained.

Embodiment 1

To begin with, four parts in weight of spherical hollow filler (micro-balloon F80S: product of Matsumoto Ushi-Seiyaku Co., Ltd.; made of acrylonitrile, softening temperature: 160-170° C.) and one part in weight of polyethylene glycol are added to 50 parts in weight of liquid A (base material: silicone rubber material KE1218 (product of Shin-Etsu Chemical Co., Ltd.), 50 parts of liquid B (hardening agent: product of Shin-Etsu Chemical Co., Ltd.). Then, the mixture, that is, the material for addition reaction cure silicone rubber was continuously stirred for 15 minutes, obtaining thereby silicone rubber compound 1.

The silicone rubber compound 1 was injected into the pressure roller formation mold 25*a*, in which the core shaft 24*e* which was made of iron and 13 mm in diameter had been mounted so that the axial line of the core shaft 24*e* coincided with the axial line of the mold 25*a*. Then, the silicone rubber compound 1 in the mold 25*a* was cured (primary cure) at 150° C. for an hour. Then, the combination of the core shaft 24*e* and cured silicone rubber compound 1 was removed from the mold 25*a*.

Thereafter, the combination was cured (secondary cure) at 200° C. for four hours, and then, was heated at 230° C. for four hours, yielding thereby a roller made up of the core shaft 24*e*, and the foam layer 24*a* formed on the peripheral surface of the core shaft 24*e*.

The foam layer 24*a* of each of the pressure rollers in the second to ninth embodiments of the present invention, and each of the examples of comparative pressure roller, was given a skin layer (which is referred to as balloon containing rubber layer in Tables 1 and 2) similar to the one with which the foam layer 24*a* in the first embodiment was given.

Described next is the method for forming the barrier layer 24*b*.

An adhesive for addition reaction cure silicone rubber was sprayed on the peripheral surface of the foamed layer 24*a* and each of the lengthwise end surfaces of the foamed layer 24*a* to a thickness of 50 μm, and was thermally cured (cured at 150° C. for 15 minutes), obtaining thereby a roller (24) having: the core shaft 24*e*; foam layer 24*a* formed on the peripheral surface of the core shaft 24*e*; and barrier layer 24*b* formed on the peripheral surface of the foam layer 24*a*. The addition reaction cure silicone rubber adhesive used in this embodiment was a half-and-half mixture of "liquid A" and "liquid B", commercial name of which is SE1819CV (product of Dow Corning Toray Co., Ltd.).

Next, referring to FIG. 5, the method used to form the elastic solid rubber layer 24*c* is described. FIG. 5 is a drawing for describing an example of the method for manufacturing the pressure roller 24.

First, silicone rubber compound 2 was obtained by mixing truly spherical particles of highly pure alumina (as filler) into the addition reaction cure silicone rubber, by 45% in volume relative to the addition reaction cure silicone rubber, and the mixture was kneaded. The addition reaction cure silicone rubbers used in this embodiment was a mixture (100:10:10) of a) DY35-1380 L BASE, b) A-1380 L M/B, and c) B1380 L M/B (product of Dow Coring Toray Co., Ltd.). The mixture was 8 pa·s in viscosity. The truly spherical particle of highly pure alumina was Alnabeaz CB A10S (commercial name: product of Showa Denko K.K.).

Next, the roller (24) formed by forming in layers the foam layer 24*a*, and barrier layer 24*b* on the peripheral surface of the core shaft 24*e* was set in the pressure roller mold 25*a*, which is 20 mm in internal diameter, in such a manner that the axial line of the core shaft 24*e* coincided with the axial line of the mold 25*a*.

Then, the uncured silicone rubber compound 2 was injected into the space between the mold 25*a* and barrier layer 24*b* through the silicone rubber compound injection holes of one of the end pieces of the mold 25*a*, in the direction parallel to the axial line of the mold 25*a* (direction indicated by arrow mark in FIG. 5).

Then, the silicone rubber compound 2 in the mold 25*a* was thermally cured at 150° C. for 30 minutes. Then, the roller having the core shaft 24*e*, foam layer 24*a*, barrier layer 24*b*, and elastic solid rubber layer 24*c* was removed from the mold 25*a*. Then, the excessive portions of the elastic solid rubber layer 24*c*, which were extending from the lengthwise end surfaces of the elastic solid rubber layer 24*c*, were trimmed, to obtain the pressure roller 24 in the first embodiment.

<Evaluation>

The pressure roller in the first embodiment was evaluated using the following method.

(1) In terms of the lengthwise direction of the pressure roller, the hardness of the pressure roller was measured at three points, that is, 25 mm from each of the lengthwise ends of the roller, and the lengthwise center of the pressure roller 24. In terms of the circumferential direction of the pressure roller, it was measured at four points, that is, with 90° intervals. The thus obtained hardness values were averaged. Then, the dispersion (Δ) of the hardness values was obtained.

(2) The thermal conductivity (in the lengthwise direction) of each pressure roller was measured.

(3) A fixing device employing the pressure roller was mounted in a color laser printer (20 ppm/min; size A4), and 300 sheets of printing paper CS814 (commercial name: 4 g/m$^2$) were conveyed through this printer, while measuring the highest surface temperature of the out-of-sheet-path area of the fixation film 23.

The measuring method used in (3) is as follows:

Measuring device: infrared thermometer Maker: NEC

Product name: TH9100MR

Measured area: entire lengthwise range of pressure roller was measured from sheet exit side of fixing device Measuring method, values obtained by calculation, and conditions under which <evaluation> was made:

Highest surface temperature of fixation film 23 detected while 300 sheets were conveyed.

Average value of highest surface temperatures of fixation film 23 detected in left and right out-of-sheet-path areas of fixing device while sheets of printing paper, which were smaller than normal size, were conveyed.

[Example 1 of Comparative Pressure Roller]

The first example of comparative pressure roller was different from the pressure roller 24 in the first embodiment in that it did not have the barrier layer 24*b*. It was formed using the following method. First, the foam layer 24*a* is formed on the peripheral surface of the core shaft 24*e* as in the first embodiment. Then, the same silicone rubber compound as the one in the first embodiment was injected into the pressure roller formation mold 25*a* without forming the barrier layer 24*b* on the peripheral surface of the foam layer 24*a*. Then, the same curing process as the one used to create the pressure roller 24 in the first embodiment was carried out to finish the first example of comparative pressure roller.

[Example 2 of Comparative Pressure Roller]

The second example of comparative pressure roller was different from the first example of comparative roller only in that it had a primer layer on the peripheral surface of the foamed layer 24*a*. It was formed using the following method. First the foam layer 24*a* was formed on the peripheral surface of the core shaft 24*e*. Then, primer for liquid silicon rubber was applied to the peripheral surface of the foamed layer 24*a* to a thickness of roughly 5 μm, and was heated at 150° C. for 15 minutes. The primer for the liquid silicone rubber was DY39-051 (commercial name: product of Dow Corning Toray Co., Ltd., half and half mixture of "liquid A" and "liquid B"). Otherwise, the second example of comparative pressure roller was the same as the pressure roller in the first embodiment.

Embodiment 2

The second embodiment is the same as the first embodiment except that the filler mixed into the addition-polymer silicone rubber in the second embodiment was pitch-based carbon fiber, and the amount by which the filler was mixed 15% in volume relative to the amount of the addition-polymer silicone rubber. The pitch-based carbon fiber was XN-100 10M (commercial name: product of Nippon Graphite Fiber Co., Ltd.), which was 900 W/(m·k) in the thermal conductivity in terms of the lengthwise direction of the fiber, and 100 μm in average fiber length, and 9 μm in fiber diameter.

The pressure roller in the third embodiment was different from the one in the second embodiment only in that it had a parting layer. It was formed using the following method: After the formation of the pressure roller in the second embodiment, the pressure roller was covered with a piece of PFA tube (as parting layer 24*d*), using addition-polymer silicone rubber adhesive SE1819CV (commercial name: product of Dow Corning Toray Co., Ltd.: half-and-half mixture of "liquid A", "Liquid B", etc.) as lubricant. The inward surface of the PFA tube was treated with ammonium.

Embodiments 4-6

The pressure rollers in the fourth to sixth embodiments were different from the one in the third embodiment only in the amount by which the pitch-based carbon fiber (filler) was mixed into the addition-polymer silicone rubber. The amounts by which the pitch-based carbon fiber was mixed are shown in Tables 1 and 2.

Embodiment 7

The pressure roller in the seventh embodiment was different from the one in the fourth embodiment only in that it had a layer of primer DY39-051 (commercial name: product of Dow Corning Toray Co., Ltd.: half-and-half mixture of "liquid A" and "liquid B) for liquid silicone rubber. It was made using the following method: After the formation of the barrier layer 24*b*, the primer was applied to the peripheral surface of the barrier layer 24*b* to a thickness of roughly 5 μm, and was heated at 150° C. for fifteen minutes. Otherwise, the pressure roller in this embodiment was the same as the one in the fourth embodiment.

Embodiment 8

The pressure roller in the eight embodiment was the same as the one in the seventh embodiment, except for the following: After the formation of the foam layer 24*a*, the primer GLP 104QR: product of Daikin Industries Co., Ltd.) was applied to the peripheral surface of the foam layer 24*a* to a thickness of roughly 5 μm, and heated at 100° C. for 10 minutes.

Then, fluorinated rubber latex GL-252E (commercial name; product of Daikin Industries Co., Ltd.; half-and-half mixture of "liquid A" and "liquid B") was sprayed as the material for the barrier layer 24*b* on the primer to a thickness of 15 μm, and thermally cured at 150° C. for 30 minutes.

[Example 3 of Comparative Pressure Roller]

This example of pressure roller was similar in structure as the one in the eighth embodiment, except that its barrier layer 24*b* is 10 μm in thickness.

Embodiment 9

The method for manufacturing the pressure roller 24 in this embodiment is the same as that for manufacturing the pressure roller 24 in the first embodiment, up to the step for forming the barrier layer on the peripheral surface of the foam layer 24*a* formed on the peripheral surface of the core shaft 24*e*. In the case of the method in this embodiment, a piece of PFA tube, which was 50 μm in thickness, the inward surface of which had been treated with ammonia, was set in the pressure roller formation mold 25*a*, which was 20 mm in internal diameter, in such a manner that the entirety of the outward surface of the PFA tube was in contact with the inward surface of the mold 25*a*.

Then, primer DY39-067 (commercial name: product of Dow Corning Toray Co., Ltd.) was uniformly sprayed on the inward surface of the PFA tube in the mold 25*a* to a thickness of 5 μm, and air-dried.

The pressure roller (24) having the core shaft 24*e*, foam layer 24*a*, and barrier layer 24*b* was set within the fluorinated resin tube 24*d* in the mold 24*a* in such a manner that the axial line of the core shaft 24*e* coincided with the axial line of the mold 25*a*. Then, the silicone compound 2 was injected into the space between the barrier layer 24*b* and fluorinated resin tube 24*d* in the direction (indicated by arrow mark A in FIG. 5) parallel to the axial line of the mold 25*a* through the silicone rubber compound 2 injection holes of the end piece 25*b* of the mold 25*a*.

Then, the silicone rubber compound 2 in the mold 25*a* was thermally cured at 150° C. for 30 minutes. Then, the roller was removed from the mold 25*a*, and the cured excessive portions of the silicone rubber compound 2 (elastic solid rubber layer 24*c*) were trimmed, to obtain the pressure roller 24 in this embodiment.

[Example 4 of Comparative Pressure Roller]

A piece of PFA tube (inward surface of which was treated with ammonia) which was 50 μm in thickness was set in the mold 25*a*, which was 20 mm in internal diameter, in such a manner that the entirety of the outward surface of the PFA tube was in contact with the inward surface of the mold 25*a*.

Then, primer DY39-067 (commercial name: product of Dow Corning Toray Co., Ltd.) was uniformly sprayed on the inward surface of the PFA tube to a thickness of 5 μm, and air-dried.

Thereafter, only the core shaft 24*e* which was made of iron and 13 mm in diameter was set in the mold 25*a*, which was 20 mm in internal diameter, and the inward surface of which was covered with the PFA tube, in such a manner that the axial line of the core shaft 24*e* coincided with the axial line of the mold 25*a*. Then, the silicone rubber compound 1 was injected into the space between the peripheral surface of the core shaft 24*e* and inward surface of the PFA tube on the inward surface of the mold 25*a*, in the direction parallel to the axial line of the mold 25*a* (indicated by arrow mark A in FIG. 5).

Then, the silicone rubber compound 1 in the mold 25*a* was thermally cured at 150° C. for 30 minutes. Then, the roller in the mold 25*a* was removed from the mold 25*a*, and the excessive portions of the cured silicone rubber compound 1 on the lengthwise end surfaces of the elastic solid rubber layer 24*c* were trimmed away to obtain the fourth example of comparative pressure roller.

Tables 1 and 2 are a summary of the laminar structures of the pressure rollers in the first to ninth embodiments, laminar structures of the first to fourth examples of comparative pressure roller, regarding the thermal conductivity of the elastic solid rubber layer 24*c* in the direction parallel to the axial line of the pressure rollers, degree of non-uniformity in hardness, and temperature increase of the out-of-sheet-path portions of the pressure rollers.

TABLE 1

| | | Primer for Foam | | Primer For Barrier | Elastic Layer | |
|---|---|---|---|---|---|---|
| | Foam layer | Layer-Barrier Layer | Barrier Layer | Layer-Elastic Layer | Filler | Amnt. Vol % |
| EMB. 1 | Resin balloon containing rubber layer | — | SE1819CV 50 μm | — | Spherical ALUMINA CB-A10S | 45 |
| COMP. 1 | Resin balloon containing rubber layer | — | — | — | Spherical ALUMINA CB-A10S | 45 |
| COMP. 2 | Resin balloon containing rubber layer | DY39-051 5 μm | — | — | Spherical ALUMINA CB-A10S | 45 |
| EMB. 2 | Resin balloon containing rubber layer | — | 1819CV 50 μm | — | Pitch-based Carbon fiber XN-100 10M | 15 |
| EMB. 3 | Resin balloon containing rubber layer | — | 1819CV 50 μm | — | Pitch-based Carbon fiber XN-100 10M | 12 |
| EMB. 4 | Resin balloon containing rubber layer | — | 1819CV 50 μm | — | Pitch-based Carbon fiber XN-100 10M | 15 |
| EMB. 5 | Resin balloon containing rubber layer | — | 1819CV 50 μm | — | Pitch-based Carbon fiber XN-100 10M | 40 |
| EMB. 6 | Resin balloon containing rubber layer | — | 1819CV 50 μm | — | Pitch-based Carbon fiber XN-100 10M | 55 |
| EMB. 7 | Resin balloon containing rubber layer | — | 1819CV 50 μm | DY39-051 5 μm | Pitch-based Carbon fiber XN-100 10M | 15 |

TABLE 1-continued

| | Foam layer | Primer for Foam Layer-Barrier Layer | Barrier Layer | Primer For Barrier Layer-Elastic Layer | Elastic Layer Filler | Elastic Layer Amnt. Vol % |
|---|---|---|---|---|---|---|
| EMB. 8 | Resin balloon containing rubber layer | GLP-104QR 5 μm | GL252E + GL-200 15 μm | DY39-051 5 μm | Pitch-based Carbon fiber XN-100 10M | 15 |
| COMP. 3 | Resin balloon containing rubber layer | GLP-104QR 5 μm | GL252E + GL-200 10 μm | DY39-051 5 μm | Pitch-based Carbon fiber XN-100 10M | 15 |
| EMB. 9 | Resin balloon containing rubber layer | — | SE1819CV 50 μm | — | Spherical ALUMINA CB-A10S | 45 |
| COMP. 4 | Resin balloon containing rubber layer | — | — | — | — | — |

TABLE 2

| | Primer For Elastic Layer-Parting Layer | Parting layer | Thermal Conductivity Of Elastic Layer in Axial Direction W/(m · k) | Hardness Of Product Left End | Hardness Of Product Center | Hardness Of Product Right End | Hardness Variation | Temp. Of Non-sheet-region deg. C. |
|---|---|---|---|---|---|---|---|---|
| EMB. 1 | — | — | 1 | 42.5 | 42 | 42.5 | 0.5 | 233 |
| COMP. 1 | — | — | 1 | 60.4 | 55 | 59.3 | 5.4 | — |
| COMP. 2 | — | — | 1 | 60.1 | 54.5 | 59.4 | 5.6 | — |
| EMB. 2 | — | — | 2.5 | 32.1 | 32 | 32.3 | 0.3 | 225 |
| EMB. 3 | SE1819CV | PFA Tube 50 μm | 2 | 46.6 | 46.1 | 46.4 | 0.5 | 233 |
| EMB. 4 | SE1819CV | PFA Tube 50 μm | 2.5 | 47.4 | 47.1 | 47.6 | 0.5 | 230 |
| EMB. 5 | SE1820CV | PFA Tube 50 μm | 11 | 53.5 | 53 | 53.5 | 0.5 | 222 |
| EMB. 6 | SE1820CV | PFA Tube 50 μm | 17 | 60 | 59.5 | 60 | 0.5 | 219 |
| EMB. 7 | SE1819CV | PFA Tube 50 μm | 2.5 | 44.5 | 44.1 | 44.6 | 0.5 | 230 |
| EMB. 8 | SE1819CV | PFA Tube 50 μm | 2.5 | 44.5 | 44.1 | 44.6 | 0.5 | 230 |
| COMP. 3 | SE1819CV | PFA Tube 50 μm | 2.5 | 59.5 | 55.9 | 60.5 | 4.6 | — |
| EMB. 9 | DY39-067 5 μm | PFA Tube 50 μm | 1 | 55 | 55 | 55.5 | 0.5 | 238 |
| COMP. 4 | DY39-067 5 μm | PFA Tube 50 μm | 0.1 | 51.4 | 51 | 51.1 | 0.4 | 255 |

The following are evident from Tables 1 and 2. That is, the pressure roller structure in the first embodiment made the pressure roller no higher in hardness, and also, more uniform in hardness, than that for the first example of comparative pressure roller, proving thereby that liquid rubber as the material for the elastic solid rubber layer was prevented from permeating into the foam layer 24*a*. Further, it is evident from the second example of pressure roller that simply adding a primer layer cannot prevent the liquid rubber as the material for the elastic solid rubber layer from permeating into the foam layer 24*a*.

The pressure roller in the eighth embodiment was less hard than the third example of comparative pressure roller. Further, not only was the third example of comparative pressure roller harder, but also, higher in the level of non-uniformity in terms of hardness, than the pressure roller in the eighth embodiment. Therefore, it is evident that the thickness of the barrier layer 24*b* has only to be no less than 15 μm.

In the second to ninth embodiments, the liquid rubber as the material for the elastic solid rubber layer was prevented from permeating into the foam layer, and the pressure rollers were uniform in hardness. The reason why the pressure rollers in the first and ninth embodiment were harder than those in the other embodiments, and the pressure rollers in the third to eighth embodiments are harder than the pressure roller in the second embodiment, is that in the first and ninth embodiments, the elastic solid rubber layer was covered with the PFA tube, and that, the third to eighth embodiments were greater in the amount of filler than the second embodiment, fourth to eighth embodiments being greater in the amount of filler than the third to seventh embodiments, respectively. In other words, it is not attributable to the permeation of the liquid rubber, as the material for the elastic solid rubber layer, into the foam layer.

The first to third examples of comparative pressure rollers were harder, and also, more non-uniform in hardness, than the pressure rollers in the embodiments of the present invention, because of the permeation of the liquid rubber, as the material for the elastic solid rubber layer, into the foam layer. Therefore, they did not deserve evaluation in terms of the temperature increase of the out-of-sheet-path portions of the pressure roller. Thus, only the temperature of the out-of-sheet-path portions of the third example of comparative pressure roller was measured, along with the temperature of the pressure rollers in the first to ninth embodiments.

Figure 6:
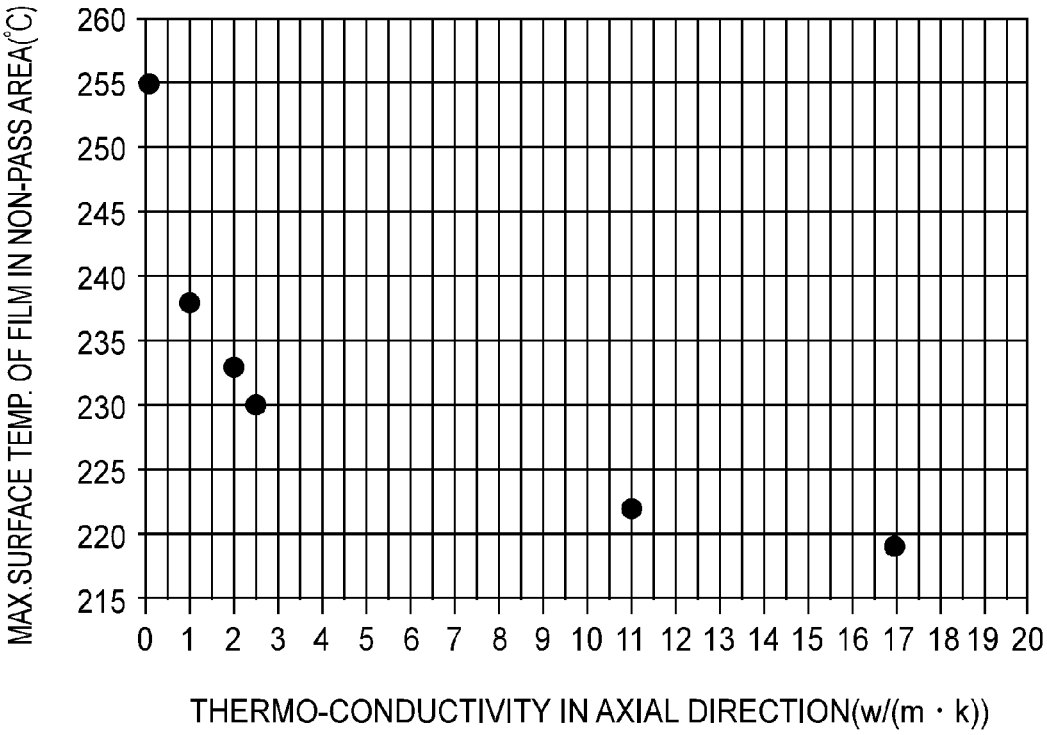
FIG. 6 is a graph which shows the relationship between the thermal conductivity of the elastic solid rubber layer of the pressure roller, in terms of the direction parallel to the axial line of the pressure roller, and the measured temperatures of the out-of-sheet-path portion of the pressure roller.
Figure 7:
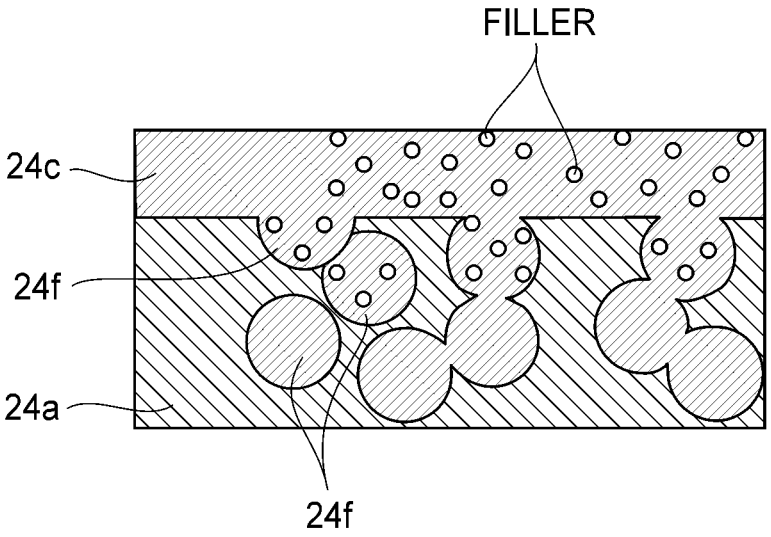
FIG. 7 is a schematic drawing of the foam layer of the pressure roller after the permeation of liquid rubber into the cells of the foam layer.

Shown in FIG. 6 is the relationship between the thermal conductivity of the elastic solid rubber layer in the direction parallel to the axial line of each pressure roller and the measured temperature of the out-of-sheet-path portions of the pressure roller. It is evident from FIG. 6 and Tables 1 and 2 that the ninth embodiment, in which the pressure roller was structured so that it had the foam layer, barrier layer, and elastic solid rubber layer, was significantly lower in the temperature of the out-of-sheet-path portions of the pressure roller, than the fourth example of comparative pressure roller, in which the roller had only the foam layer.

Further, it is evident from the comparison between the pressure roller in the ninth embodiment, and those in the third to eighth embodiments that a pressure roller, the filler of which is pitch-based carbon fiber, is less in the temperature increase of the out-of-sheet-path portions of the pressure roller, than a pressure roller, the filler of which is in the form of spherical particles. In other words, for the purpose of minimizing (preventing) the temperature increase of the out-of-sheet-path portions of a pressure roller, it requires a smaller amount of pitch-based carbon fiber than the spherical filler. Further, by mixing pitch-based carbon fiber into the material for the elastic solid rubber layer 24*c* of a pressure roller, by an amount large enough to make the resulting elastic solid rubber layer 24*c* no less than 2.0 W/(m·k) in thermal conductivity in the direction parallel to the axial line of the pressure roller, it is possible to obtain a pressure roller which is superior in thermal conductivity than a conventional pressure roller, which uses spherical filler.

The pressure roller 24 in accordance with the present invention is provided with the barrier layer 24*b*, which is formed on the peripheral surface of the foam layer 24*a*, and which prevents the liquid rubber, as the material for the elastic solid rubber layer 24*c*, from permeating into the foam layer 24*a*. Therefore, it is significantly more elastic, and less non-uniform in hardness (elasticity) than any pressure roller in accordance with the prior art.

Not only is an image heating device in accordance with the present invention usable for fixing an unfixed toner image to a sheet of recording medium, but also, as a glossing apparatus (device) for reheating a fixed toner image on a sheet of recording medium to improve the toner image in gloss.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 093221/2011 and 057080/2012 filed Apr. 19, 2011 and Mar. 14, 2012, respectively, which are hereby incorporated by reference.

What is claimed is:

1. A roller for a fixing device, said roller comprising:

a foam layer including porous cells;

an elastic layer containing a thermo-conductive filler and provided outside of said foam layer; and a middle layer provided between said foam layer and said elastic layer;

wherein said middle layer is free of the porous cells, and wherein said middle layer is free of all filler including said thermo-conductive filler, or a content of all filler in said middle layer is smaller than a content of all filler in said elastic layer.

2. The roller according to claim 1, wherein said middle layer comprises silicone rubber or fluorine-containing rubber and has a thickness of not less than 15 μm and not more than 500 μm.

3. The roller according to claim 1, wherein a filler content of said middle layer is not more than 10 vol %.

4. The roller according to claim 1, wherein a thermal conductivity of said elastic layer in an axial direction of said roller is not less than 2.0 W/(m k).

5. The roller according to claim 1, wherein said thermo-conductive filler is a pitch-based carbon fiber.

6. The roller according to claim 5, wherein the amount by which the pitch-based carbon fiber is mixed into a base material for the elastic layer is in a range of 15-55% in volume.

7. The roller according to claim 1, wherein the porous cells are formed by hollow fillers.

8. The roller according to claim 7, wherein the hollow fillers are at least one selected from the group of a glass balloon, a silica balloon, a carbon balloon, a phenol resin balloon, a vinylidene chloride resin balloon, an acrylonitrile resin balloon, a balloon formed of a copolymer of vinylidene chloride and (metha) acrylonitrile, an alumina balloon, a zirconia balloon, and a silas balloon.

9. The image heating apparatus according to claim 7, wherein the porous cells are formed by a water-absorbent polymer soaked with water.

10. The roller according to claim 1, wherein the porous cells are formed by a water-absorbent polymer soaked with water.

11. The roller according to claim 1, wherein the porous cells are formed by a water absorbent polymer soaked with water or hollow fillers, and wherein the amount in volume ratio by which the water absorbent polymer or the hollow fillers is mixed into a base material for the foam layer is in a range of 10-80%.

12. An image heating apparatus comprising:

a heating unit for heating an image formed on a recording material;

a roller cooperative with said heating unit to form a nip for nipping and feeding the recording material, said roller comprising:

a foam layer including porous cells;

an elastic layer containing a thermo-conductive filler and provided outside of said foam layer; and a middle layer provided between said foam layer and said elastic layer;

wherein said middle layer is free of the porous cells, and wherein said middle layer is free of all filler including said thermo-conductive filler, or a content of all filler in said middle layer is smaller than a content of all filler in said elastic layer.

13. The apparatus according to claim 12, wherein said middle layer comprises silicone rubber or fluorine-containing rubber and has a thickness of not less than 15 μm and not more than 500 μm.

14. The apparatus according to claim 12, wherein a filler content of said middle layer is not more than 10 vol %.

15. The apparatus according to claim 12, wherein a thermal conductivity of said elastic layer in an axial direction of said roller is not less than 2.0 W/(m k).

16. The apparatus according to claim 12, wherein said thermo-conductive filler is a pitch-based carbon fiber.

17. The apparatus according to claim 16, wherein the amount by which the pitch-based carbon fiber is mixed into a base material for the elastic layer is in a range of 15-55% in volume.

18. The apparatus according to claim 12, wherein said heating unit includes an endless belt contacting said roller.

19. The apparatus according to claim 18, wherein said heating unit includes a heater contacting an inner surface of the endless belt.

20. The image heating apparatus according to claim 12, wherein the porous cells are formed by hollow fillers.

21. The image heating apparatus according to claim 20, wherein the hollow fillers are at least one selected from the group consisting of a glass balloon, a silica balloon, a carbon balloon, a phenol resin balloon, a vinylidene chloride resin balloon, an acrylonitrile resin balloon, a balloon formed of a copolymer of vinylidene chloride and (metha) acrylonitrile, an alumina balloon, a zirconia balloon, and a silas balloon.

22. The image heating apparatus according to claim 12, wherein the porous cells are formed by a water absorbent polymer soaked with water or hollow fillers, and wherein the amount in volume ratio by which the water absorbent polymer or the hollow fillers is mixed into a base material for the foam layer is in a range of 10-80%.

* * * * *